US005510880A

United States Patent [19]

Song

[11] Patent Number: 5,510,880

[45] Date of Patent: Apr. 23, 1996

[54] COMPENSATION DEVICE FOR SENSITIVITY OF THE PHOTOSENSITIVE DRUM OF COPYING APPARATUS

[75] Inventor: Yong Il Song, Buchon, Rep. of Korea

[73] Assignee: Hyundai Electronics Ind. Co., Ltd., Kyeongki, Rep. of Korea

[21] Appl. No.: 172,739

[22] Filed: Dec. 27, 1993

[30] Foreign Application Priority Data

Dec. 30, 1992 [KR] Rep. of Korea ..... 1992-26624

[51] Int. Cl.[6] ..... G03G 15/04

[52] U.S. Cl. ..... 355/228; 355/71

[58] Field of Search ..... 355/228, 232, 355/210, 35, 71, 211

[56] References Cited

U.S. PATENT DOCUMENTS

| | | | |
|---|---|---|---|
| 4,176,943 | 12/1979 | Hasebe | 355/232 X |
| 4,279,497 | 7/1981 | Satomi | 355/71 |
| 4,607,941 | 8/1986 | Honda | 355/228 X |
| 4,699,494 | 10/1987 | Honda | 355/228 X |
| 5,006,497 | 11/1991 | Nakata et al. | 355/71 |

FOREIGN PATENT DOCUMENTS

| | | |
|---|---|---|
| 58-14164 | 1/1983 | Japan . |
| 62-92969 | 4/1987 | Japan . |
| 62-70891 | 4/1987 | Japan . |

*Primary Examiner*—Nestor R. Ramirez
*Attorney, Agent, or Firm*—Wenderoth, Lind & Ponack

[57] ABSTRACT

In an copying apparatus of the cartridge type having a photosensitive drum, a staticization charger, a destaticizer and any other peripheral processor units, a variable width slit formed above the drum and in the optical path between the light source and the photosensitive drum for regulating the amount of light reaching the drum. The variable width slot acts as a compensation devise to compensate for varying sensitivity of the photosensitive drum. The width of the slot is altered by changing the position of a sliding adjustor member so as to vary the amount of light reaching the drum to compensate for the variation of the sensitivity of the drum resulting from the various manufacturing parameters thereby enhancing the reliability of the manufactured apparatus.

3 Claims, 1 Drawing Sheet

COMPENSATION DEVICE FOR SENSITIVITY OF THE PHOTOSENSITIVE DRUM OF COPYING APPARATUS

In an electrophotographic development apparatus of the cartridge type which contains a photosensitive drum, a staticization charger and any other necessary peripheral processor units which are assembled in a common housing, this invention relates to a device for correcting the photosensitivity of the photosensitive drum against variation of drum sensitivity.

A photoconductor directed to use for image development in an electrophotographic copying apparatus, laser printer, or the like may be formed by an anticorrosive aluminum cylindrical hollow precursor which is applied on the circumference with a film coating of organic photoconductive materials about 20 microns thick. In general, such photoconductor drums have different degrees of sensitivity due to the fact that thickness of the applied films as charge transfer layer and charge generation layer varies from one member to another and because materials are not uniform in composition from one lot to another. If the electrophotographic development apparatus has a photoconductor drum of varying sensitivity loaded therein without any parameter not charged in response to the variation of the drum sensitivity, the operation parameters will be influenced thereby preventing full efficiency from being achieved as intended. In prior art, thus, a compensation means for compensation of varied sensitivity of drums had to be provided in the development station of the electrophotographic apparatus.

An electrophotographic development apparatus with photosensitivity compensation has been known which includes a symbol or indicia of sensitivity ranges of the drum being inserted in the lot number indication affixed to the respective photoconductive drums for conveying the information about the drum sensitivity to service or maintenance personnel upon assembling the electrophotographic developer or upon replacing a spent drum with a new drum so that the maintenance personnel can displace switch means relating to a source voltage for a light source for illuminating an original to be copies or a staticization charger to adjust the intensity of light for illuminating an original or the output of the charger, thereby permitting compensation for the variation of the drum sensitivity.

The above stated cartridge type of copying apparatus has been known to have a protrusion located in the cartridge housing for indication of the sensitivity of the individual photosensitive drum contained in the cartridge. The apparatus base has a sensor for detecting the position of the protrusion on the cartridge as the cartridge is loaded in the apparatus base to indicate the sensitivity of the loaded drum.

In this conventional copying apparatus, means are disposed for varying the source voltage of the illumination light source or the output of the staticization charger in response to the drum sensitivity sensed by the sensor. The sensor is required to be separately provided, complicating the arrangement of the developer with increased manufacturing costs. It would be burdensome on the service or maintenance personnel to make adjustments regarding the drum sensitivity for the individual units. The adjustment operation is prone to errors or maladjustment.

According to the invention, the sensitivity variation of the drums inherently caused from the limitations of manufacture can be compensated for by varying light intensity delivered to the drum through an adjustable slit opening, thus achieving easy, accurate adjustment of sensitization of the photosensitive drum. The invention thus permits the intended functionality and efficiency of the electrophotographic development apparatus to be more reliably achieved due to the accurate compensation against the drum sensitivity. Means for compensation for the drum sensitivity are according to this invention formed by a combination of a slit opening and an adjustor member related to the slit opening and is thus very simple and accordingly easy to manufacture and to handle.

This invention also helps preventing foreign materials such as dirt from accessing to the drum periphery through the slit opening, thus keeping the drum peripheral surface clean thereby prolonging its life.

BRIEF DESCRIPTION OF THE ACCOMPANYING DRAWINGS

The embodiment of the invention is shown in accompanying drawings, of which:

DESCRIPTION OF THE PREFERRED EMBODIMENT

The embodiment of the invention will be described with reference to the accompanying drawings.

A sensitivity compensation device according to the invention may be formed by provision of an adjustor member 9 sliding horizontally in a slit opening 10 which is formed relative to a photosensitive drum. A light beam may pass through the slit opening with the width of the gap set by adjustor member 9 and the light permeability of the adjustor member 9 setting the amount of light amount that reaches the drum. The adjustor member may slide for varying the width of the slit opening or hole to control the light amount that reaches the drum.

Figure 1:
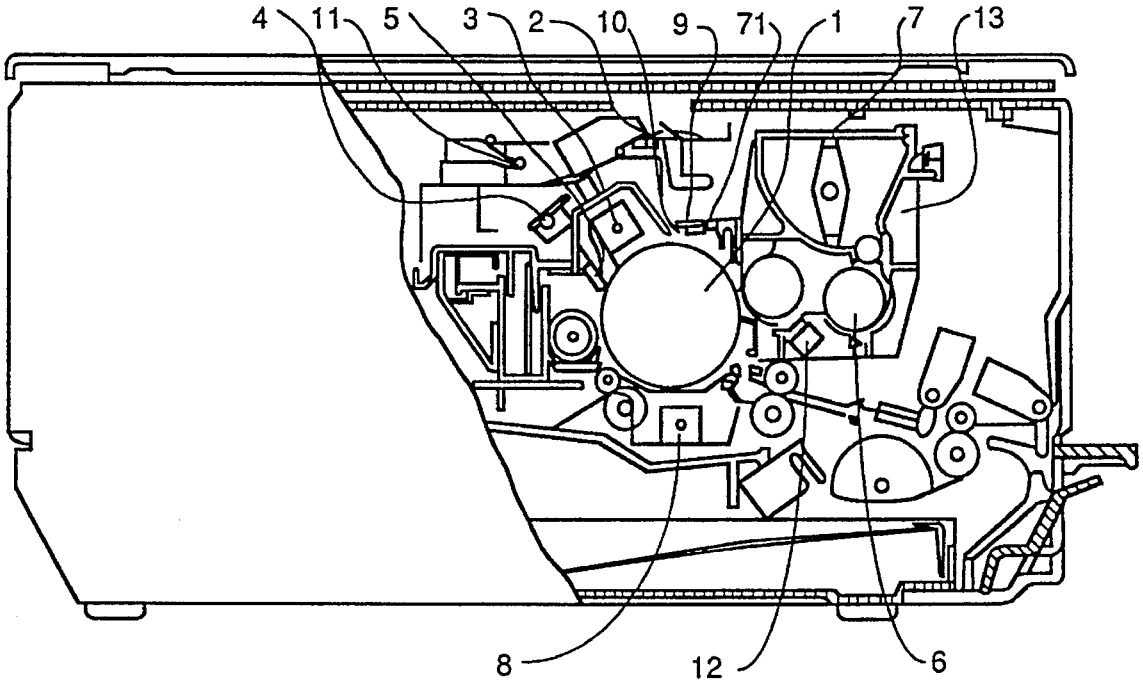
FIG. 1 shows a side, partially broken away view showing an electrophotographic development apparatus and a compensation device of the invention incorporated therein.

Referring to FIG. 1, a photosensitive drum 1 has a Selfoc lens 2, staticization charger 3, destaticizer 4, cleaner blade 5 and magnetic roller 6 provided in its periphery and assembled bodily in a common housing 7. The cartridge type herein mentioned has a photoconductive drum and an exposure slit in a body, and may or may not include a developer.

Figure 2A:
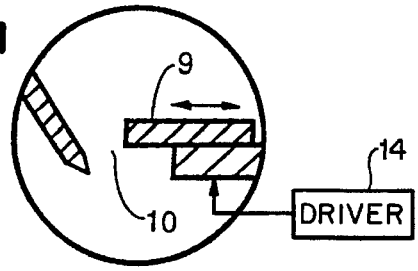
FIG. 2 shows an enlarged view of the drum sensitivity compensation device.
Figure 2:
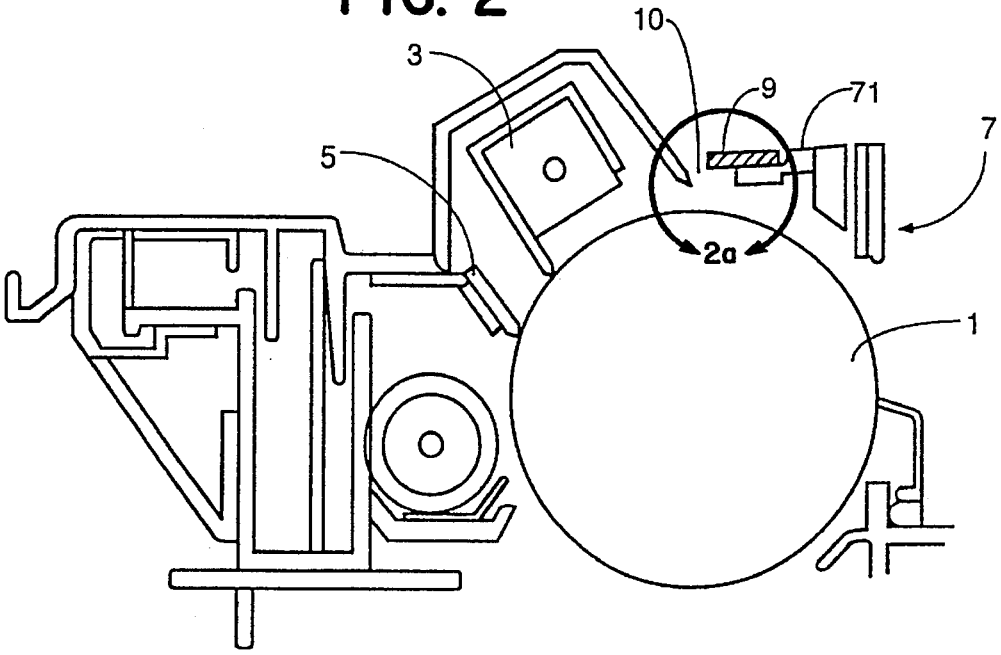

As shown in FIG. 2, there is a slit opening or hole 10 formed to have a size for passing of a light beam through a space between the staticization charger 3 located in the periphery of the drum and a bracket 71 carried by the housing 7 in a forward position of the drum rotation relative to the charger 3.

The slit hole or opening should be preferably located beneath the lens 2 (not shown in FIG. 2). The adjustor member 9 has one end lying on the upper side of the bracket 71 and mounted so as to slide toward the side face of the staticization charger 3.

The driver 14 of the adjustor member 9 may be a rack and pinion means for receiving force from drive mechanism of the copying apparatus under control of signals of the controller for control the overall operation of the copying apparatus, so that the member 9 can be thereby driven in sliding relationship with bracket 71. Alternatively, handle means may be provided in the ends of adjustor member 9 to project through the apparatus body for manually driving the adjustor member 9 from without.

The adjustor member 9 is shown clearly in FIG. 2 to be disposed over the slit hole or opening 10 between the housing bracket 71 and the charger unit size 3 spaced from the bracket.

Preferably, the adjustor member 9 may be formed by a glass plate which is selected from a plurality of glass plates different in light permeability from each other. An adjustor member 9 having the smaller light permeability should be selected for a photosensitive drum having the greater light sensitivity, and vice versa. The adjustor member 9 of the selected light permeability thus permits and appropriate amount of light to irradiate the photosensitive drum for compensation for its sensitivity.

The photocopying apparatus shown in FIG. 1 has an image transfer unit 8, a toner concentration detector 12, a light source 11 and a developer cartridge 13, which are to be omitted from the description.

The effect of the embodiment of the invention will be described.

The provision of the adjustor member 9 over the slit hole 10 formed between the charger 3 and bracket 71 located above the photosensitive drum whose light sensitivity can not fixed to a constant degree due to the manufacture parameters enables the light beam generated by the light source 11 or halogen lamp and reflected from an original to be copied to be adjusted, as it passes through the slit hole or opening 10, to an amount corresponding to the size of the slit hole or opening. This size is adjusted by the adjustor plate, thereby to provide the light amount compensating for the sensitivity of the drum.

The drum cartridge generally comprises photoconductive drum 1, staticization charger 3, cleaning blade 5, exposure slit opening 10, etc. in one body in the common housing and as loaded in the copying apparatus base the peripheral surface of the drum in the cartridge is irradiated by a light beam emitted from the halogen lamp 11 and reflected from the surface of an original to be copied placed on the platen, the light beam being then converged by the self-focus lens array 2 and passing through the slit opening relative to the bracket 71 of the housing 7. As the passage of light from the halogen lamp to the drum surface has the adjustor member 9 for varying the slit width or size, a light beam generated from the source can be adjusted in an amount before reaching the drum surface, thus permitting compensation for the sensitivity of the photosensitive drum.

In otherwords, if the photosensitive drum to be loaded has a higher sensitivity than the reference, the adjustor 9 may be driven into the slit opening, reducing the width of the latter. If the sensitivity of a drum is smaller, the adjustor 9 may be driven in the opposite direction increasing the width of the slit opening. This will adjust the amount of light passing through the slit opening or slit for compensation for the sensitivity of the photosensitive drum.

If the adjustor is made from glass selected from a number of glass materials having different light permeabilities, an adjustor member having different light permeabilities may provided and an adjustor may be selected which has a light permeability appropriate for the sensitivity of the photosensitive drum and this adjustor may be incoporated in the drum cartridge upon manufacture. By this means, compensation of the photosensitive drum can be easily achieved for variations in sensitivity from one drum to another may be achieved.

The adjustor member 9 in the drum sensitivity compensation device of the invention not only acts to vary a slit opening or hole, but also prevents dust particles or any alien matter from entering through the slit opening to the drum peripheral surface.

From the foregoing description it is understood that the provision of the slit width adjustment member according to the invention in an electrophotographic development apparatus of the cartridge type where the photosensitive drum, staticization charger, destaticization unit and other necessary process units are assembled in one body in a common housing can easily achieve a precise compensation for the variation of the sensitivity of the photosensitive drum inherently present in the manufacturing technology of the photosensitive drums, instead of provision of switch means for voltage adjustment of high voltage stations in the copying apparatus, thus enhancing reliability of the copying apparatus. According to the invention, the opening of the slit hole formed in the cartridge housing can be adjusted to compensate for the difference of the sensitivity of the drums. Dust particles can be shut off according to the invention from the drum peripheral surface which is thus kept clean.

What is claimed is:

1. In an image forming apparatus having a photosensitive drum (1), a lens (2), a staticization charger (3), a destaticizer (4), a cleaning blade (5), a magnetic roller (6) in a body in a common housing, a compensation device for compensating for the light sensitivity of the particular photosensitive drum (1) in said image forming apparatus, comprising: a bracket (71) carried by said housing, a slit opening (10) formed between said bracket (71) and said charger (3) above the photosensitive drum (1) for passing a light therethrough, and an adjustor member (9) mounted on said bracket so as to be able to slide toward or away from said charger (3) for adjusting the width of said slit opening and being made of a material which passes light but has a reflectivity selected to compensate for the light sensitivity of said photosensitive drum.

2. The device defined in claim 1 wherein said adjustor member (9) is formed by a plate being coupled by a coupling means to a drive means for driving said adjustor member (9) in sliding relationship with bracket (71) in response to the light sensitivity of said photosensitive drum (1).

3. In an image forming apparatus having a photosensitive drum (1), a lens (2), a staticization charger (3), a destaticizer (4), a cleaning blade (5), a magnetic roller (6) in a body in a common housing, a compensation device for compensating for the light sensitivity of the particular photosensitive drum (1) in said image forming apparatus, comprising: a bracket (71) carried by said housing, a slit opening (10) formed between said bracket (71) and said charger (3) above the photosensitive drum (1) for passing a light therethrough, and an adjustor member (9) mounted on said bracket so as to be able to slide toward or away from said charger (3) for adjusting the width of said slit opening, and wherein said adjustor member (9) is made of glass selected from a plurality of different glasses, each having different light permeabilities, said adjustor member (9) having a selected light permeability appropriate for compensation for the light sensitivity of the particular photosensitive drum in said image forming apparatus, said adjustor member (9) being mounted in said slit opening (10).

* * * * *